US010311841B2

(12) United States Patent
Lafrenz

(10) Patent No.: US 10,311,841 B2
(45) Date of Patent: Jun. 4, 2019

(54) ELECTRONIC MALLET CONTROLLER WITH RANGE ADJUSTMENT/LOW NOTE ASSIGNMENT

(71) Applicant: Pearl Musical Instrument Co., Chiba (JP)

(72) Inventor: Shawn D. Lafrenz, Murfreesboro, TN (US)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 16/051,526

(22) Filed: Aug. 1, 2018

(65) Prior Publication Data

US 2019/0139522 A1 May 9, 2019

Related U.S. Application Data

(60) Provisional application No. 62/581,841, filed on Nov. 6, 2017.

(51) Int. Cl.
*G10H 1/00* (2006.01)
*G10H 1/34* (2006.01)

(52) U.S. Cl.
CPC ..... *G10H 1/0016* (2013.01); *G10H 1/344* (2013.01); *G10H 2220/026* (2013.01); *G10H 2220/185* (2013.01)

(58) Field of Classification Search
CPC ..... G10H 1/0066; G10H 1/38; G10H 7/00; G10H 3/00; G10H 2250/641; G10H 2220/051; G10H 2220/056; G10H 1/346; G10H 2220/221; G10G 1/00; G10C 3/12; G10C 5/10; G10D 13/003; G10D 13/02
See application file for complete search history.

(56) References Cited

U.S. PATENT DOCUMENTS 5,421,236 A * 6/1995 Sanger ..... G04F 5/025 84/464 R
5,440,071 A * 8/1995 Johnson ..... G10H 1/34 84/637
9,105,260 B1 * 8/2015 Helms ..... G10H 1/386
2002/0134223 A1 * 9/2002 Wesley ..... G10H 1/0066 84/719
2009/0044685 A1 * 2/2009 Usa ..... G10H 1/0008 84/600

(Continued)

*Primary Examiner* — Marlon T Fletcher
(74) *Attorney, Agent, or Firm* — Manelli Selter PLLC; Edward J. Stemberger

(57) ABSTRACT

An electronic mallet controller includes a plurality of bars representing musical notes. Each bar active produces a signal indicative of the respective musical note when struck by an implement, and all adjacent bars are spaced apart with the same spacing. A first user input permits a user to select a lowest diatonic natural note of the range of the musical instrument to thereby define a location of dead notes. A processor circuit interprets each signal as an outputted musical note. Based on the first user input, the processor circuit shifts mapping between the bars and the musical notes to be outputted, causing the dead note locations to be associated with certain of the bars, and wherein the bars at the dead note locations are inactive bars. An indicator is associated with the inactive bars to indicate the location of the dead notes to the user.

20 Claims, 6 Drawing Sheets

(56) References Cited

U.S. PATENT DOCUMENTS

| | | | | |
|---|---|---|---|---|
| 2012/0031254 | A1* | 2/2012 | Hotrique | G10C 3/12<br>84/423 R |
| 2014/0083281 | A1* | 3/2014 | McPherson | G10H 1/02<br>84/615 |

* cited by examiner

ELECTRONIC MALLET CONTROLLER WITH RANGE ADJUSTMENT/LOW NOTE ASSIGNMENT

This application claims the benefit of the earlier filing date of U.S. Provisional Application No. 62/581,841, filed on Nov. 6, 2017, and claims the benefit thereof for priority purposes. The content of U.S. Provisional Application No. 62/581,841 is hereby incorporated into this specification by reference.

FIELD

The invention relates to an electronic mallet keyboard controller with an adjustable low note range function allowing the user to set the needed fundamental diatonic note of the instrument.

BACKGROUND

Electronic mallet keyboard controllers generally allow a user to merely vary the mode and functionality in which the pitch and/or the modulation of an output sound signal is altered. However, these mallet controllers do not permit range adjustment or selective low note assignment.

Accordingly, there is a need to provide electronic mallet keyboard controller with an adjustable low note range function.

SUMMARY

An object of the invention is to fulfill the need referred to above. In accordance with the principles of the present embodiment, this objective is achieved by providing an electronic mallet controller including a housing having an upper surface. A plurality of bars representing musical notes is associated with the upper surface. Each bar, when active, is constructed and arranged to produce a signal indicative of the respective musical note when struck by an implement so as to define a musical instrument, and all adjacent bars are spaced apart with the same spacing. A first user input is constructed and arranged to permit a user to select a lowest diatonic natural note of the range of the musical instrument to thereby define a location of dead notes. A processor circuit is constructed and arranged to interpret each signal as an outputted musical note. Wherein, based on the first user input, the processor circuit is constructed and arranged to shift mapping between the bars and the musical notes to be outputted, causing the dead note locations to be associated with certain of the bars, and wherein the bars at the dead note locations are inactive bars. An indicator is associated with the inactive bars to indicate to the user the location of the dead notes.

In accordance with another aspect of an embodiment, a method of adjusting a low note assignment of a mallet controller provides a mallet controller including a housing having an upper surface, and a plurality of bars representing musical notes associated with the upper surface. Each bar, when active, is constructed and arranged to produce a signal indicative of the respective musical note when struck by an implement so as to define a musical instrument. All adjacent bars being spaced apart with the same spacing. A first low note assignment is set by shifting mapping between bars and the respective musical notes to be outputted, causing dead note locations to be associated with certain of the bars, wherein the bars at the dead note locations are inactive bars. Each of the inactive bars and thus the dead note locations is identified. When an active bar is struck, an associated musical note signal is outputted based on the low note assignment setting.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF EXEMPLARY EMBODIMENTS

Figure 1:
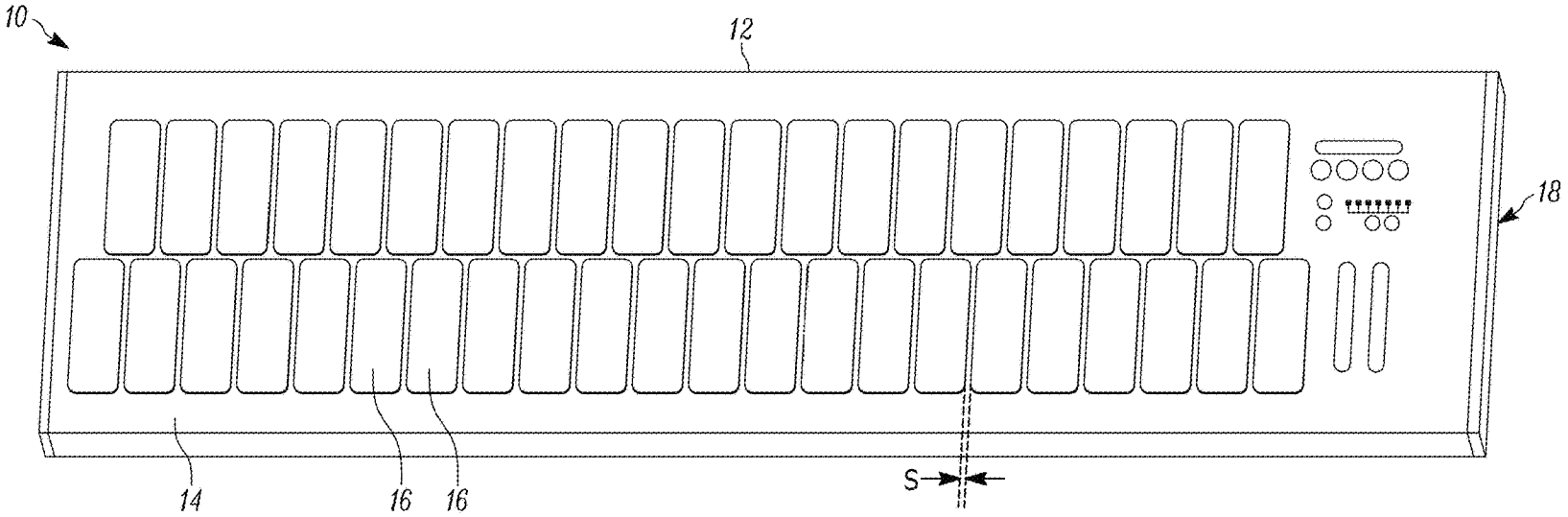
FIG. 1 is a plan view of an electronic mallet controller provided in accordance with an embodiment.

With reference to FIG. 1, an electronic mallet controller is shown generally indicated at 10 in accordance with an embodiment of the invention. The mallet controller 10 includes a body 12 having an upper surface 14 approximating the chromatic tone bar layout of a traditional acoustic mallet keyboard percussion instrument (i.e., a marimba or vibraphone or other similar device) by the provision of a plurality of tone bars 16, plates, or other device(s) fixed in location with respect to the surface 14 so that the bars 16 can be struck with mallet or other stick implements. Thus, the mallet controller 10 defines a stand-alone, three octave musical instrument or an instrument that can be played along with other instruments such as a vibraphone (not shown). The bars 16 are preferably of silicone providing an all-weather playing surface.

Figure 2:
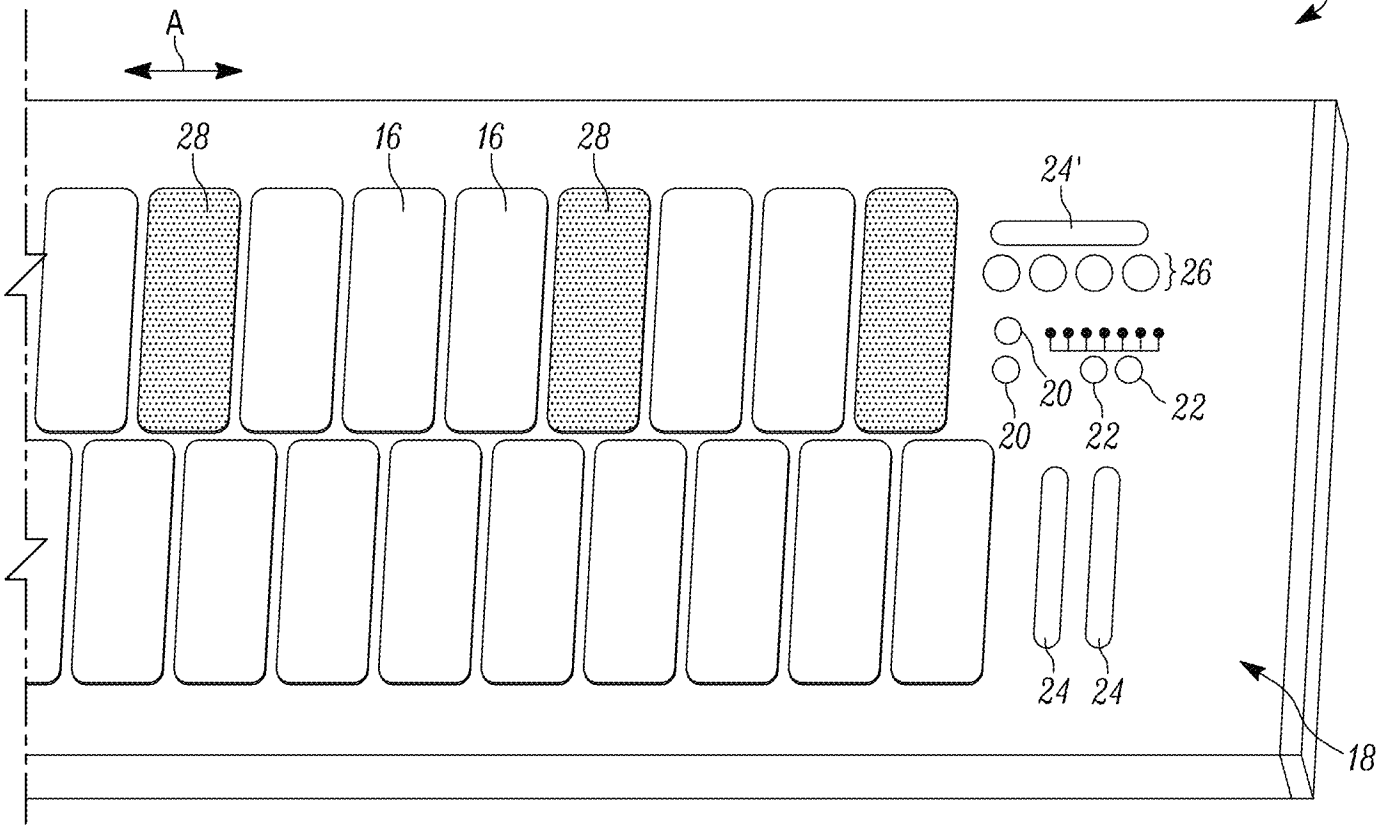
FIG. 2 is an enlarged, partial plan view of the electronic mallet controller of FIG. 1, showing caps over dead-note tone bars.
Figure 4:
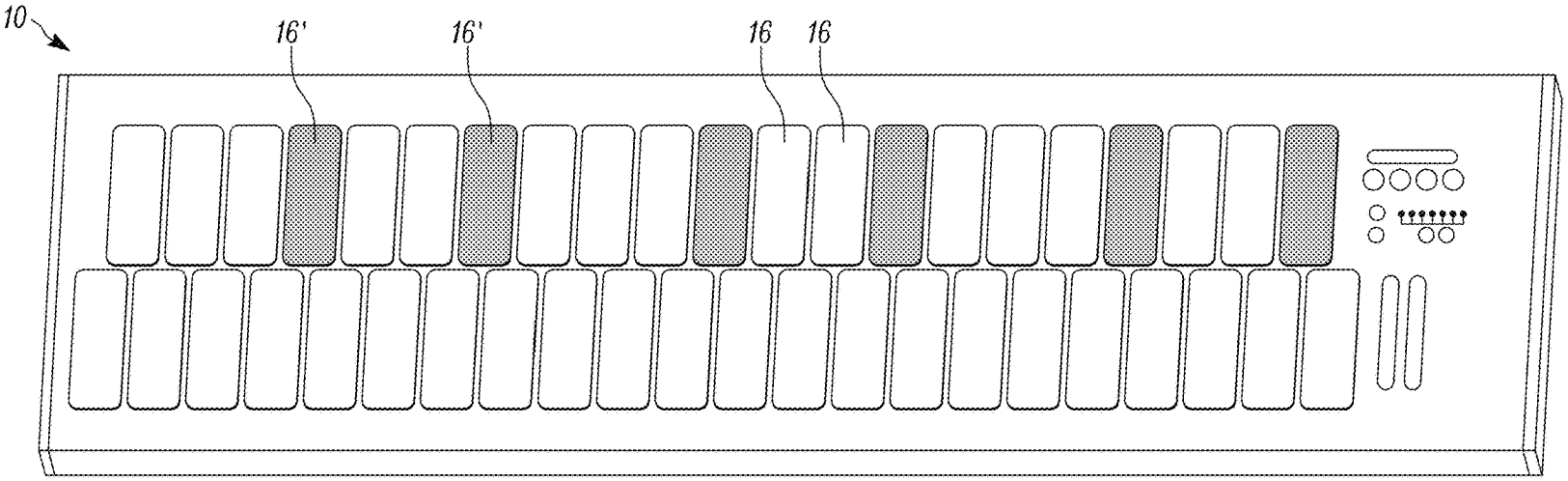
FIG. 4 is a plan view of the electronic mallet controller of FIG. 1, showing a certain dead-note tone bars being back-lit.

As best shown in FIG. 2, the mallet controller 10 includes control panel, generally indicated at 18, controlled by a processor circuit 44 (FIG. 4). The control panel 18 preferably includes two (up/down) octave shift buttons 20, two (up/down) low note shift buttons 22, three software assignable fader buttons 24, and four software assignable buttons 26. When used herein "buttons" can include knobs, sliders, or other control devices. A power on/off button and volume control button can be provided on the control panel or anywhere on the body 12 of the mallet controller 10.

The octave buttons 20 allow the user to shift the range of the instrument two octaves up or down from a default position. The buttons 20 can illuminate in different colors to distinguish between the two octaves. For example, the respective button 20 can be illuminated green for one octave shift and red for two octave shift.

The fader buttons 24 are vertical faders and can be set by default to modulation and pitch bend. Fader button 24' is a horizontal fader. The assignable buttons 26 can be set by default to MIDI note 64, MIDI note 65, MIDI note 66 and MIDI note 67, respectively. Buttons 24, 24' and 26 can be easily changed in a software editor (not shown).

Figure 3:
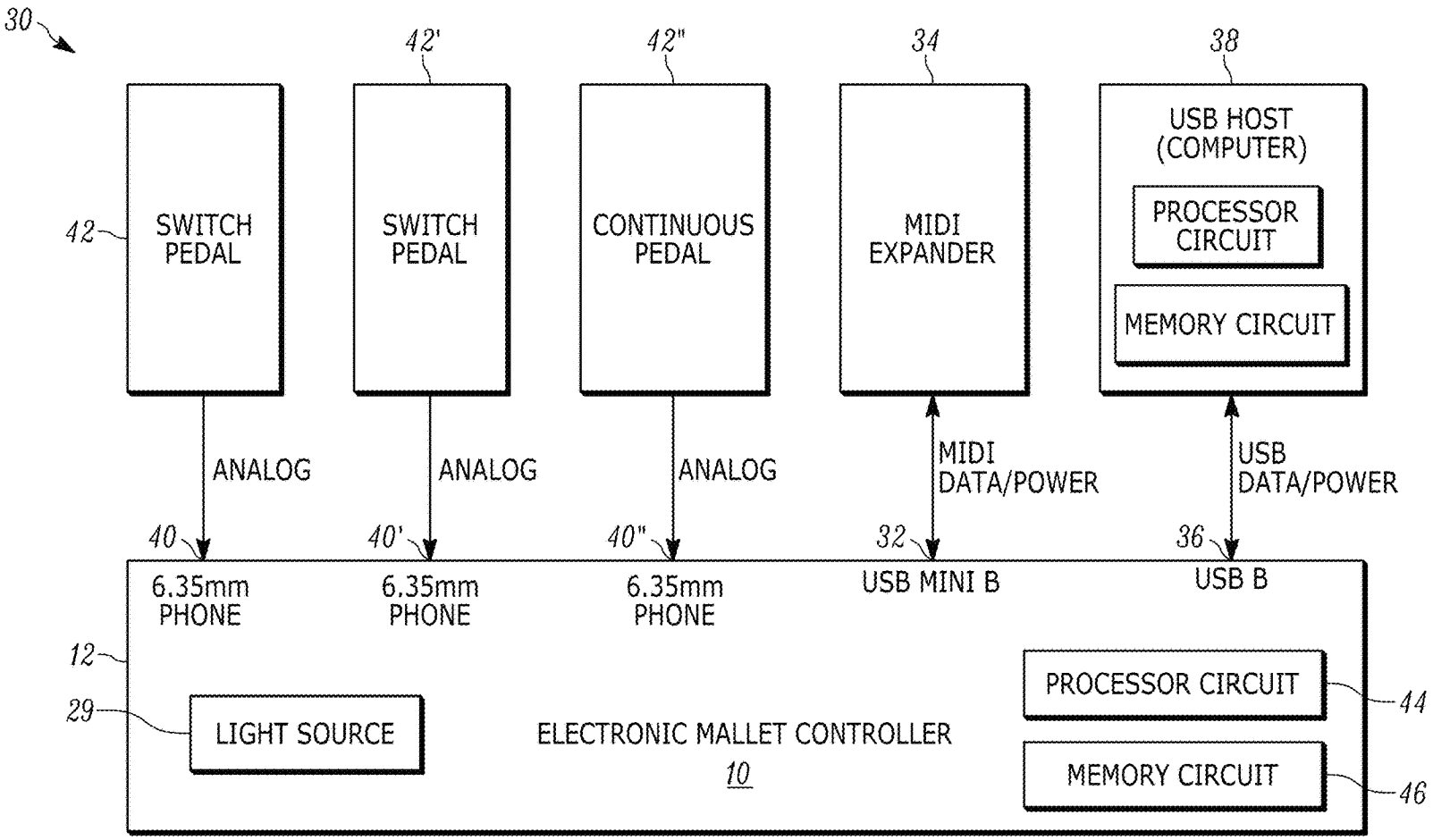
FIG. 3 is a schematic view of a system including the electronic mallet controller of FIG. 1.

FIG. 3 is a schematic illustration of the mallet controller 10 as part of a system, generally indicated at 30. The mallet controller 10 includes a plurality of outputs, preferably at the rear of the body 12, for connecting with external components. As shown in FIG. 3, a USB Mini port 32 is used for connecting with a Musical Instrument Digital Interface (MIDI) expander 34; a standard USB port 36 is used for connecting with a host such as a computer 38 or mobile device; and preferably three assignable MIDI ports 40, 40' and 40" are used for connecting with foot pedals 42, 42' and 42", respectively. The pedal inputs can be for example, expression, switch and sustain. The USB port 36 also provides power to the controller 10.

Figure 5:
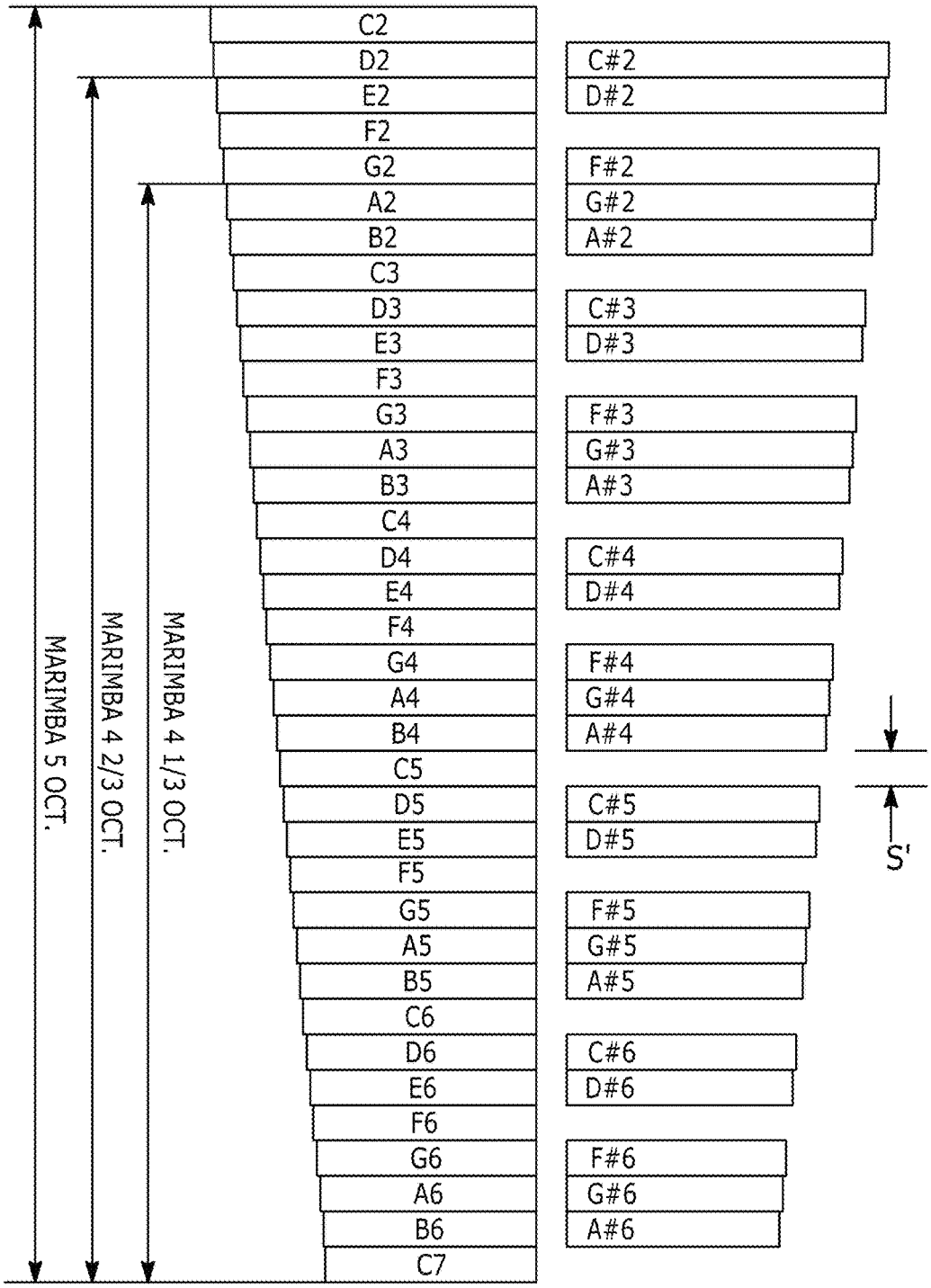
(PRIOR ART) FIG. 5
FIG. 5 is a plan view of a conventional western 12-note chromatic octave keyboard.

The mallet controller 10 is a MIDI controller, meaning that it does not have any built-in sounds on the controller 10. The sounds are generated by the user's device of choice such as a computer or mobile device. Any app capable of receiving MIDI will work with the mallet controller 10. A processor circuit 44 of the mallet controller 10 produces signals generated by the striking of the bars 16 that are interpreted through an MIDI or serial USB connection to any tone generating unit (e.g., computer 38 or mobile device) in regular chromatic arrangements of notes in a traditional western 12-note chromatic octave mallet keyboard pattern regardless of the low-note assignment. Therefore, instead of a traditional fixed pattern of twelve tone bars in the western chromatic keyboard tradition as shown in FIG. 5, a complete pattern of playing bars 16, without spaces between the traditional 2-3 accidental note grouping, is provided on the mallet controller 10 (FIG. 1). In particular, as shown in FIG. 1, there is a constant spacing S between all adjacent bar 16 and thus no need for the large space S' between the 2-3 accidental note grouping of the keyboard shown FIG. 5. The low note shift buttons 22 allow the user to change the diatonic low note of the mallet controller 10 as described further below.

As shown in FIG. 2, dead note caps 28 are provided that can manually cover bars 16 (preferably in a color different from the color of the bars 16) to represent the accidental position of the selected range. With reference to FIG. 4, instead of providing the caps 28, software of the controller 10 can cause a light source 29 (FIG. 3) to back-light certain dead-note (non-active) tone bars 16', indicating which tone bars 16 are assigned to produce pitches (active bars). In FIG. 4, the backlit bars 16' are shown in a default F-F mode. Thus, the caps 28 or illuminated bars define an indicator to indicate the inactive (dead-note) bars 16' to a user.

The low note assignment feature, enabled via buttons 22 on the mallet controller 10, is implemented in software executed by the processor circuit 44 using the combination of a lookup table in memory circuit 46 and a low note offset value. The lookup table describes a multi-octave chromatic scale with place-holder values (−1) to indicate "dead-notes" on the instrument.

TABLE 1

Scale Degree Lookup Table

| C, | C#, | D, | D#, | E, | x, | F, | F#, | G, | G#, | A, | A#, | B, | x |
|---|---|---|---|---|---|---|---|---|---|---|---|---|---|
| {0, | 1, | 2, | 3, | 4, | −1, | 5, | 6, | 7, | 8, | 9, | 10, | 11, | −1, |
| 12, | 13, | 14, | 15, | 16, | −1, | 17, | 18, | 19, | 20, | 21, | 22, | 23, | −1, |
| 24, | 25, | 26, | 27, | 28, | −1, | 29, | 30, | 31, | 32, | 33, | 34, | 35, | −1, |
| 36, | 37, | 38, | 39, | 40, | −1, | 41, | 42, | 43, | 44, | 45, | 46, | 47, | −1}; |

In a traditional keyboard instrument, an unbroken sequence of integers maps to the white and black keys of the chromatic scale. However, the arrangement of bars 16 on the mallet controller 10 is such that two bars 16 per octave must be "dead" (inactive) because there is no note between E/F and B/C. Table 1 holds four octaves of the chromatic scale starting from C, using a representation of musical notes with integers that is compatible with MIDI. The 'x' in the labeling indicates "no note". Table 1 begins with zero because it is simple to change octaves by simply adding multiples of twelve to each pitch value. The low note assignment feature of the mallet controller 10 requires shifting the mapping between the physical instrument's bars 16 and the musical notes to be output such that the "dead" notes move up or down (in the directions of arrow A relative to the upper surface 14 in FIG. 2) when the user selects a different lowest note. The caps 28 are then placed on the corresponding dead-note bars 16' or these inactive bars 16' are back-lit, as noted above, so as to identify them to the user.

Figure 6:
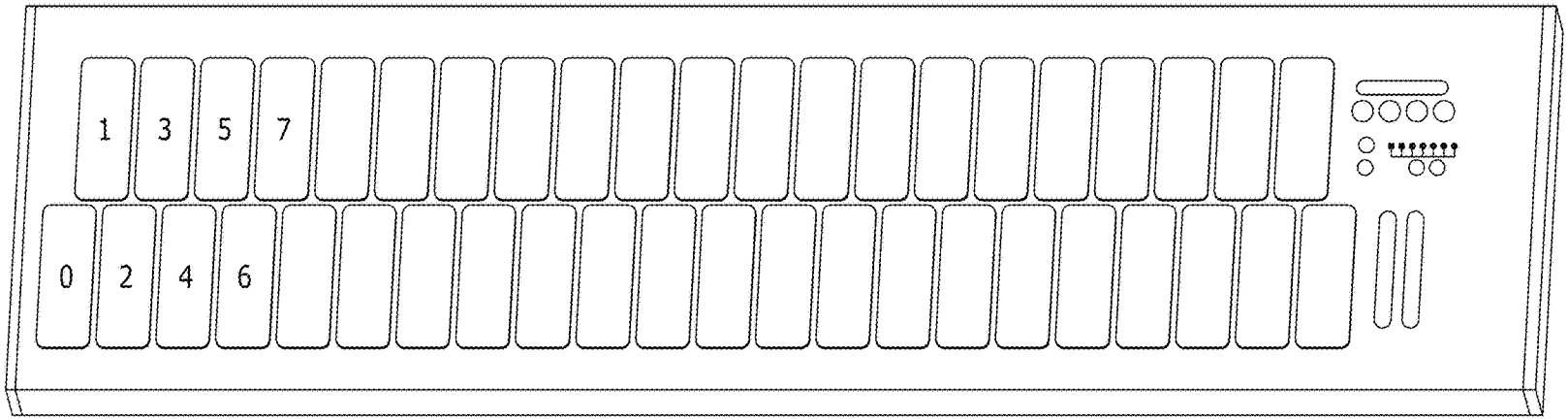
FIG. 6 is a pan view of the electronic mallet controller of FIG. 1, showing internal bar numbering.

Internally, the keys/bars 16 of the instrument 10 are numbered from zero to forty two, with only seven shown as numbered as an example in FIG. 6. When a player strikes a bar 16, the firmware uses the bar number to calculate the MIDI pitch to output based on the low note assignment setting and the octave shift setting. This is accomplished by addressing the lookup table in Table 1 using both a physical key number (zero-relative) and the offset value set by the user via buttons 22 on the control panel 18. In the firmware's internal representation, a low note offset is a value between 0 and 12 and key number is a value between 0 and 41.

When a player strikes a bar 16, the pitch is calculated by the processor circuit 44, for example, as:

1. The mallet controller 10 generates a "bar struck" event which includes the bar number.
2. The current low-note-shift value is added to the bar number.
3. The sum resulting from step 2 is used to lookup the scale degree.
4. If the value from step 3 is not −1 (i.e., "no note"), an octave shift is applied.
5. A MIDI note is transmitted using the value from step 4.

To use a concrete example where the mallet controller's low note is the pitch F3 and the player strikes the lowest bar:

barNumber=0;

lowNoteOffset=6;

tableIndex=barNumber+lowNoteOffset; 6+0=6

Referring back to Table 1, the $6^{th}$ element of the lookup table is the number 5 which is the scale degree F. Because F3 is desired, (12*3) is added to the 5 in order to get F3 which is MIDI note number 41.

The operations and algorithms described herein can be implemented as executable code within the processor circuit 44 shown in FIG. 4 and as described, or stored on a standalone computer or machine readable non-transitory tangible storage medium that are completed based on execution of the code by a processor circuit implemented using one or more integrated circuits. Example implementations of the disclosed circuits include hardware logic that is implemented in a logic array such as a programmable logic array (PLA), a field programmable gate array (FPGA), or by mask programming of integrated circuits such as an application-specific integrated circuit (ASIC). Any of these circuits also can be implemented using a software-based executable resource that is executed by a corresponding internal processor circuit such as a microprocessor circuit (not shown) and implemented using one or more integrated circuits, where execution of executable code stored in an internal memory circuit (e.g., within the memory circuit 46 shown in FIG. 4) causes the integrated circuit(s) implementing the processor circuit to store application state variables in processor memory, creating an executable application resource (e.g., an application instance) that performs the operations of the circuit as described herein. Hence, use of the term "circuit" in this specification refers to both a hardware-based circuit implemented using one or more integrated circuits and that includes logic for performing the described operations, or a software-based circuit that includes a processor circuit (implemented using one or more integrated circuits), the processor circuit including a reserved portion of processor memory for storage of application state data and application variables that are modified by execution of the executable code by a processor circuit. The memory circuit can be implemented, for example, using a non-volatile memory such as a programmable read only memory (PROM) or an EPROM, and/or a volatile memory such as a DRAM, etc.

The range adjustment/low note assignment feature of the mallet controller 10 is a unique and novel development and is not to be confused with "transposing" or "octave" assignments which are unrelated and independent functions, common to many electronic musical devices. The result of the range adjustment/low note assignment function of the mallet controller 10 is an advancement in electronic mallet controller functionality due to a user being able adjust the layout of the instrument to fit a particular musical phrase or pattern within the available playing surfaces, while still playing in a particular key or sticking pattern comfortable for the music excerpt required.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An electronic mallet controller comprising:

a housing having an upper surface;

a plurality of bars representing musical notes associated with the upper surface, each bar, when active, being constructed and arranged to produce a signal indicative of the respective musical note when struck by an implement so as to define a musical instrument, all adjacent bars being spaced apart with the same spacing, a first user input constructed and arranged to permit a user to select a lowest diatonic natural note of the range of the musical instrument to thereby define a location of dead notes;

a processor circuit constructed and arranged to interpret each signal as an outputted musical note, wherein based on the first user input, the processor circuit is constructed and arranged to shift mapping between the bars and the musical notes to be outputted, causing the dead note locations to be associated with certain of the bars, wherein the bars at the dead note locations are inactive bars, and an indicator associated with the inactive bars to indicate the location of the dead notes to the user.

2. The mallet controller of claim 1, wherein the indicator is a cap constructed and arranged to cover over the inactive bar.

3. The mallet controller of claim 2, wherein the cap is of a color different from a color of the bars.

4. The mallet controller of claim 1, wherein the indicator includes a light source constructed and arranged to backlight the inactive bar.

5. The mallet controller of claim 1, further comprising a second user input constructed and arranged, when activated, to cause the processor circuit to shift the range of the musical instrument two octaves up or down from a default position.

6. The mallet controller of claim 1, further comprising a USB input so that power can be supplied to the mallet controller and data can be sent from the mallet controller.

7. The mallet controller of claim 1, further comprising a plurality of inputs for attaching foot pedals.

8. The mallet controller of claim 1, further comprising an MIDI input so that power can be supplied to the mallet controller and data can be sent from the mallet controller.

9. The mallet controller of claim 1, further comprising at least one vertical fader button and at least one horizontal fader button operable with the processor circuit to control fade.

10. A method of adjusting a low note assignment of a mallet controller, the method comprising:

providing a mallet controller comprising a housing having an upper surface, and a plurality of bars representing musical notes associated with the upper surface, each bar, when active, being constructed and arranged to produce a signal indicative of the respective musical note when struck by an implement so as to define a musical instrument, all adjacent bars being spaced apart with the same spacing, setting a first low note assignment by shifting mapping between bars and the respective musical notes to be outputted, causing dead note locations to be associated with certain of the bars, wherein the bars at the dead note locations are inactive bars, identifying each of the inactive bars and thus the dead note locations, and when an active bar is struck, outputting an associated musical note signal based on the low note assignment setting.

11. The method of claim 10, further comprising setting a second low note assignment by shifting mapping between bars and the respective musical notes to be outputted, causing new dead note locations to be associated with bars that are different from the certain bars, and wherein the identifying step includes identifying the bars associated with the new dead note locations.

12. The method of claim 10, further comprising, prior to the outputting step, shifting an octave of the musical instrument, and wherein the outputting step includes outputting an associated musical note based on the low note assignment setting and the octave shift.

13. The method of claim 10, wherein the identifying step comprises placing a cap over each inactive bar.

14. The method of claim 10, wherein the identifying step comprising back-lighting each inactive bar.

15. The method of claim 10, wherein the musical note signal is an MIDI signal.

16. The method of claim 10, wherein the setting step employs a processor circuit and the setting step comprises:

assigning a number to each of the bars, adding, in the processor circuit, a low-note-shift value to the bar number of a struck bar to define a sum, employing a lookup table in a memory circuit of the mallet controller so that the processor circuit determines a scale degree based on the sum, and if the value of the scale degree is not indicated of a dead note, applying, by the processor circuit, an octave shift.

17. The method of claim 10, wherein the setting step is initiated by a user activing at least one button on the mallet controller.

18. The method of claim 12, wherein the shifting step is initiated by a user activing at least one button on the mallet controller.

19. The method of claim 10, further comprising providing a computer or mobile device to receive the outputted musical note signal.

20. The method of claim 19, wherein the computer or mobile device is electrically connected to the mallet controller via a USB connection.

* * * * *